United States Patent [19]

Seitz et al.

[11] Patent Number: 4,667,489

[45] Date of Patent: May 26, 1987

[54] DUST EXTRACTION EQUIPMENT FOR FLAT BED KNITTING MACHINES

[75] Inventors: Herbert Seitz, Nuremberg; Eugen Frosch, Hiltpoltstein, both of Fed. Rep. of Germany

[73] Assignee: H. Stoll GmbH. & Co., Fed. Rep. of Germany

[21] Appl. No.: 842,166

[22] Filed: Feb. 21, 1986

[30] Foreign Application Priority Data

Feb. 22, 1985 [DE] Fed. Rep. of Germany ..... 3506142

[51] Int. Cl.[4] ..... D04B 35/20

[52] U.S. Cl. ..... 66/168

[58] Field of Search ..... 66/168

[56] References Cited

U.S. PATENT DOCUMENTS 2,482,670 9/1949 Imbriani ..... 66/168

3,461,693 8/1969 Klaeui ..... 66/168

FOREIGN PATENT DOCUMENTS 3130584 2/1983 Fed. Rep. of Germany ..... 66/168

3305795 8/1984 Fed. Rep. of Germany ..... 66/168

*Primary Examiner*—Ronald Feldbaum

*Attorney, Agent, or Firm*—Larson and Taylor

[57] ABSTRACT

In the present invention, the entire equipment, a suction blower with drive motor, suction nozzles (1) directed towards the needle beds (2) and at least one due collecting chamber (5) for the dust extraction device for flat bed knitting machines, is arranged on the machine carriage (14/15).

For this, a dust collecting chamber (5) is designed within the inner space of a hollow carriage bracket (14,15) and the collected fibre dust or lint can be compacted and discharged by means of a conveyor screw (45).

9 Claims, 11 Drawing Figures

Figure 1:
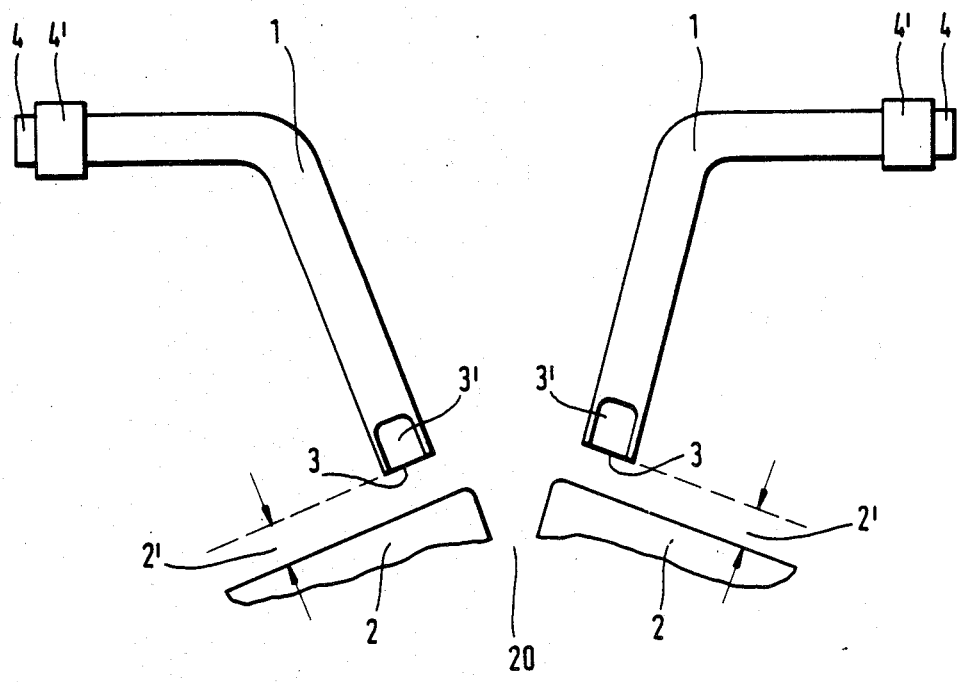

FIG. 3
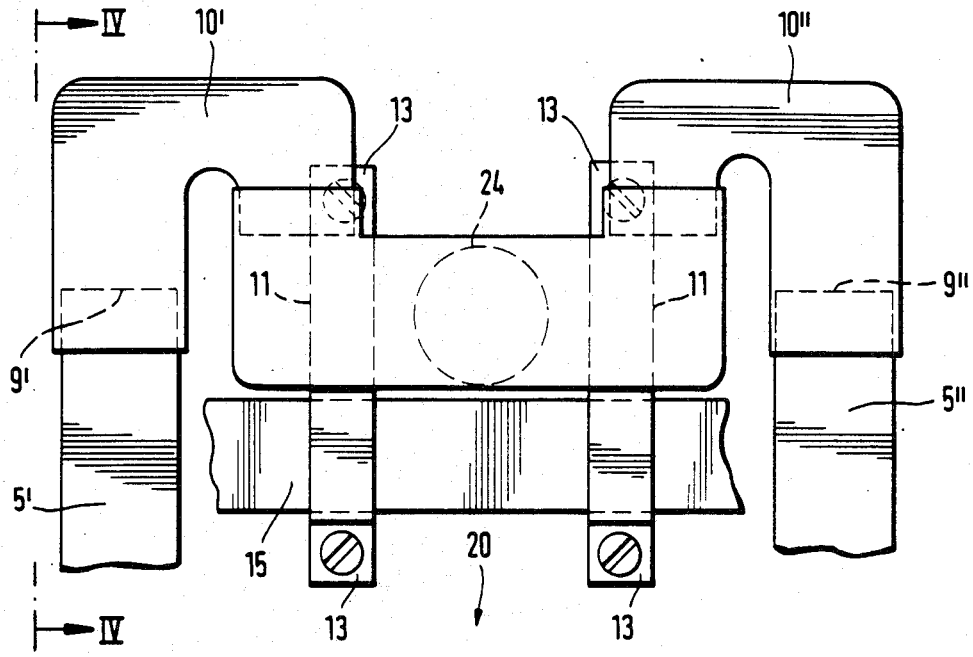
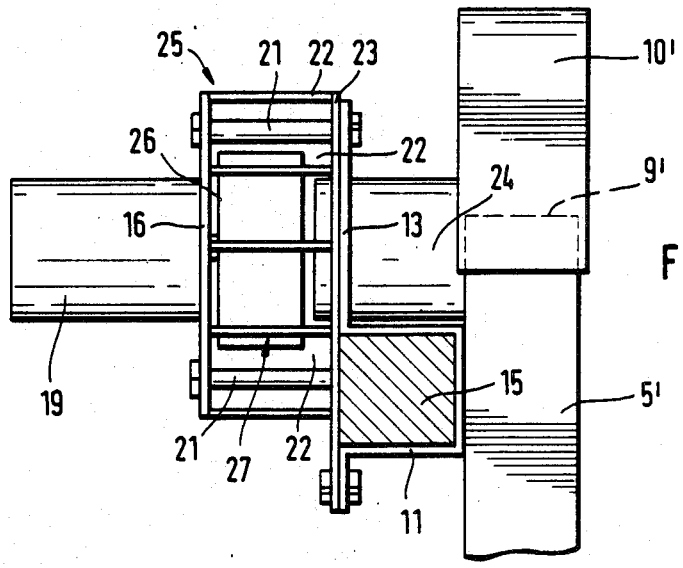
FIG. 4

DUST EXTRACTION EQUIPMENT FOR FLAT BED KNITTING MACHINES

The invention concerns a dust extraction system for flat bed knitting machines, in which the dust fibres falling during knitting are sucked away through a suction unit by means of suction nozzles, which slide back and forth over the needle beds with the carriage.

Systems in which the falling fibre or dust or lint is removed from the suction nozzles into a fibre dust collector by means of suction are already known. Personnel are hampered during the operation whilst the knitting is in progress by the suction lines, whether these are rigid or flexible; this increases the likelihood of the need for maintenance work.

The present invention provides a duct extraction device for flat bed knitting machines having an electromotor driven suction blower and a dust collecting chamber and having suction nozzles directed at the needle bed or beds, adjustably arranged on the carriage of the flat bed knitting machine, wherein the suction blower together with the drive motor and the dust collecting chamber are all arranged on the machine carriage.

In an example of the invention a suction nozzle may be connected directly to the fibre dust collector by two methods of construction, the suction nozzle end has a screw thread, which screws into the inlet port of the fibre dust collector and is locked with a locking screw; for the second method of construction the suction nozzle end is introduced into the inlet port, and locked on its lower external face, whereby the compression spring holds the suction nozzle end in the retaining angle. The suction nozzle orifice is provided at one end with a slot, which serves to improve fibre collection.

The fibre dust collectors, which are arranged to run up to the top of the side wall of the rear and front carriage bracket base, are insertable in retaining angle brackets, which are fixed to supports and are formed as U-shaped walls with a bottom transverse supporting base, the fibre dust collector being fixed by a flexible strap by means of suspension hooks in a securement device and adjustable safety fastenings.

The blower housing consists of a carrier plate, carrying supports for the blower, a rear wall positioned in the direction of the knitting zone, protective grid bars and the inlet plate. The suction units consist of drive motors and blower housings; these are securely attached on three sides by a support and support ends to the front and rear carriage arm base with the curved web of the carrier plate, or are fixed to carriage top brackets by the support and support ends on the inlet plate.

In the event of the lack of space, the suction units are mounted between the bobbin board and the carriage body in association with the fibre dust collector. In each case the design principle is the same, a vacuum is drawn at the outlet port of the fibre dust collector through an air filter or dust bag, leaving the fibre dust behind via the suction elbow into the inlet feed pipe, the diameter of which is smaller than the internal diameter of the ventilator. When the fibre dust collector becomes completely full, its replacement is very easy and convenient to effect.

The fitting or installation of fibre dust collectors is possible in suitable hollow cavities of a carriage arm body, and is advantageous through saving of space.

The agglomeration of the fibre dust collected is effected by a conveyor screw operating in the interspace in the fibre dust collector, and the fibre dust is forced through an opening, formed into wads and conveyed into the pipe leading down away from the collector.

There will now be described an example of devices according to the invention. It will be understood that the description which is to be read with reference to the drawings is given by way of example only and not by way of limitation.

Figure 2:
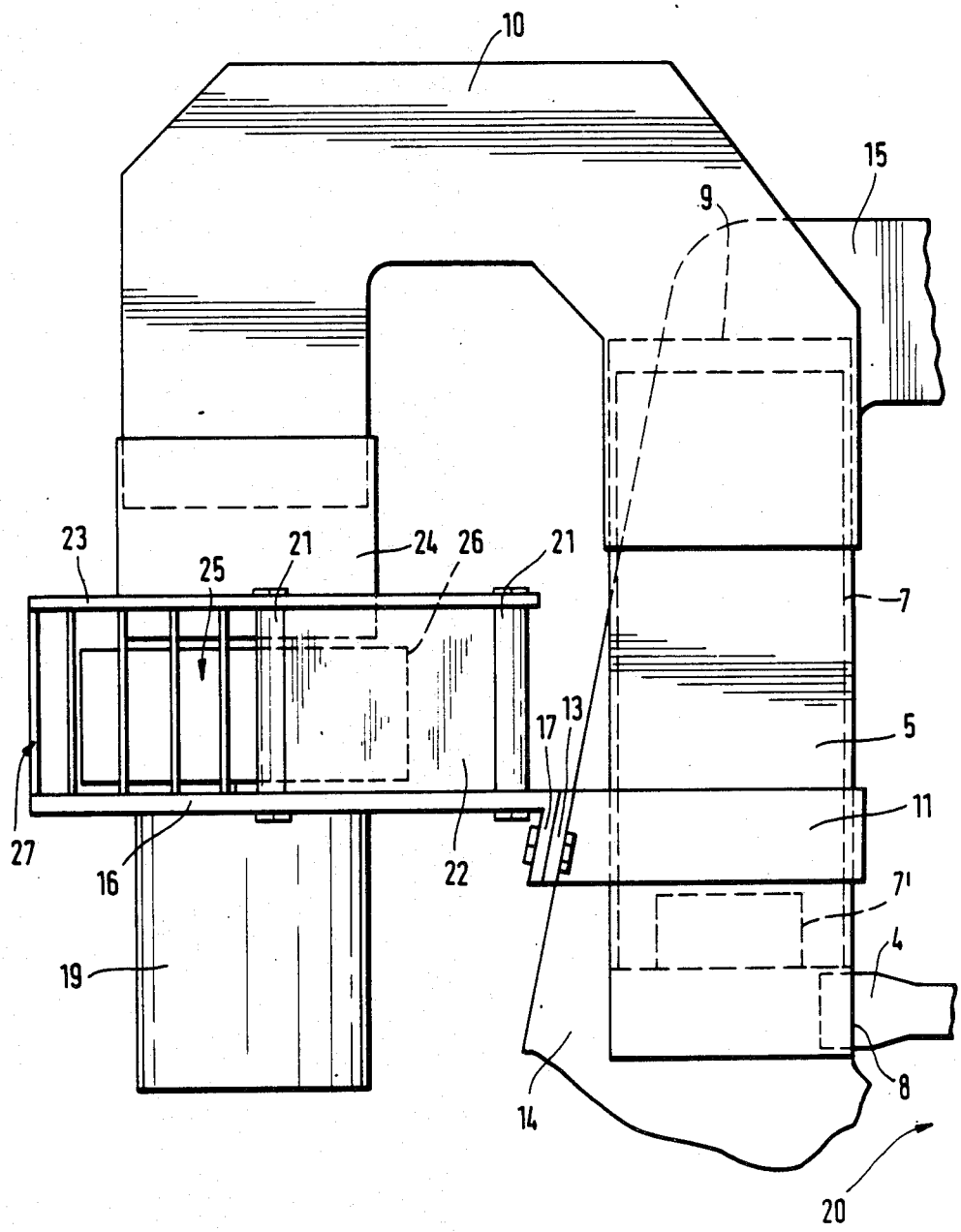

In the drawings:

FIG. 1 is a schematic cross section through the knitting forming zone of a flat bed knitting machine between two needle beds and suction nozzles supported by the carriage (not shown) and arranged over the ends of the needle bed, FIG. 2 is a schematic presentation of suction unit of the dust extraction device arranged on the carriage of a flat bed knitting machine.

Figure 5:
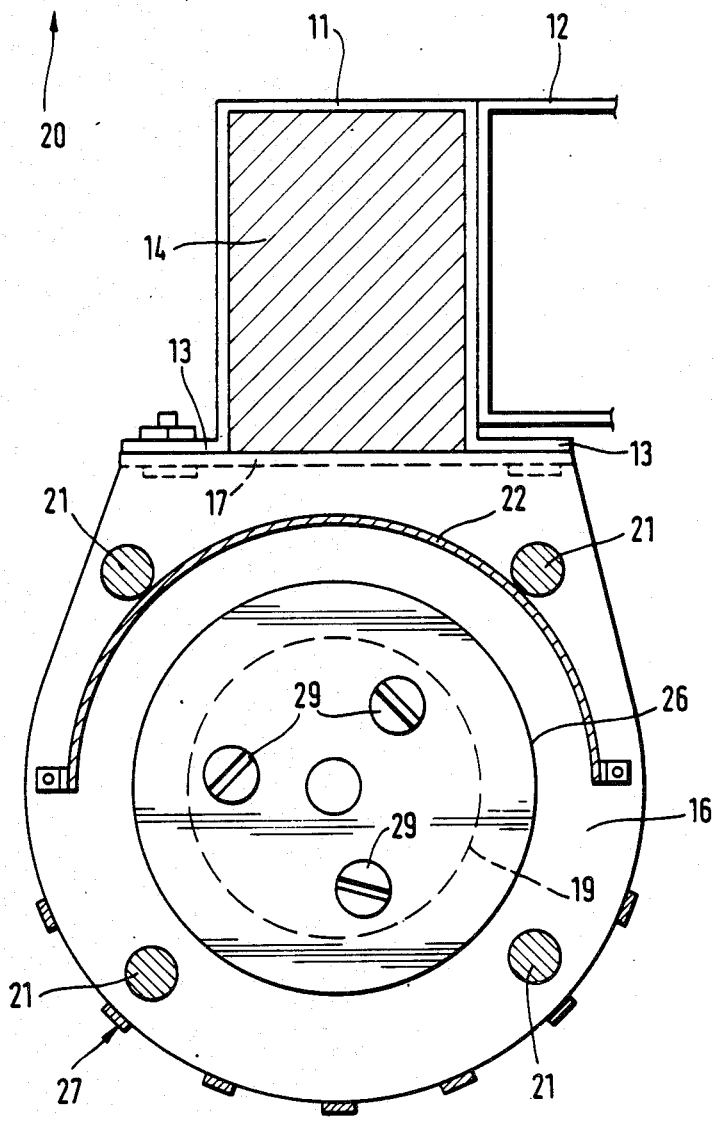
Figure 6:
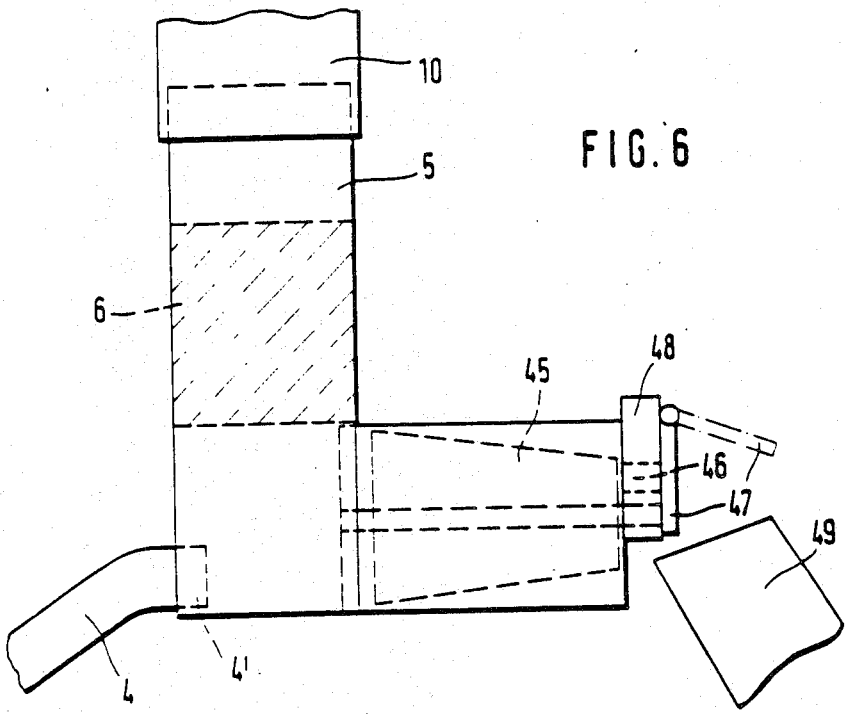
Figure 7:
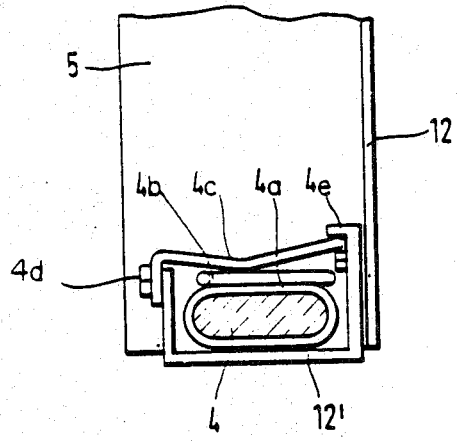
Figure 8:
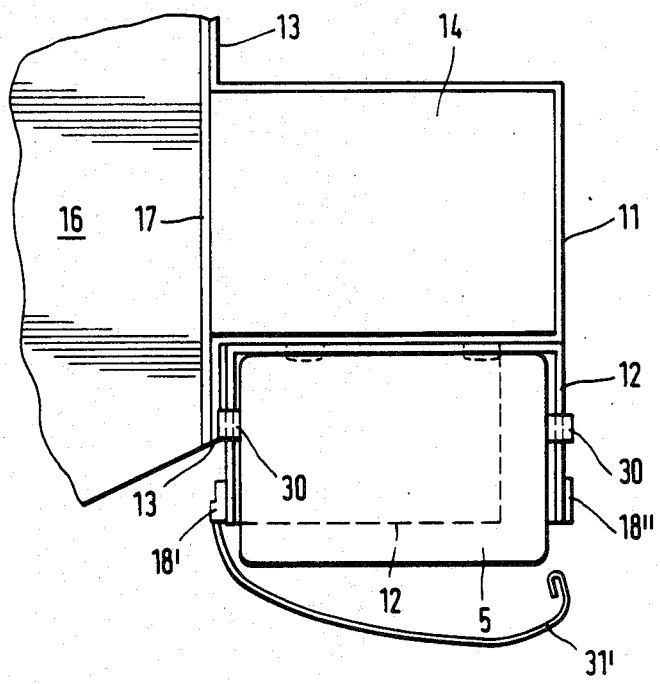
Figure 9:
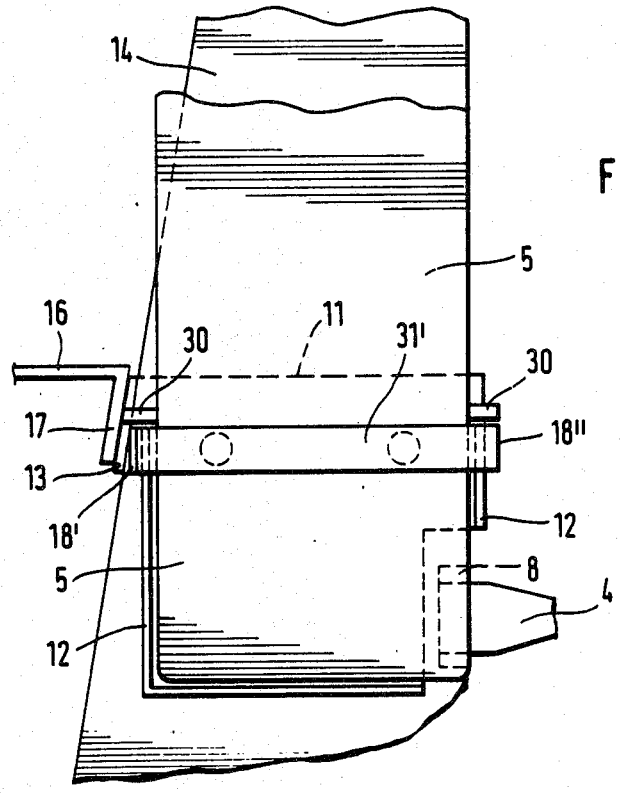
Figure 10:
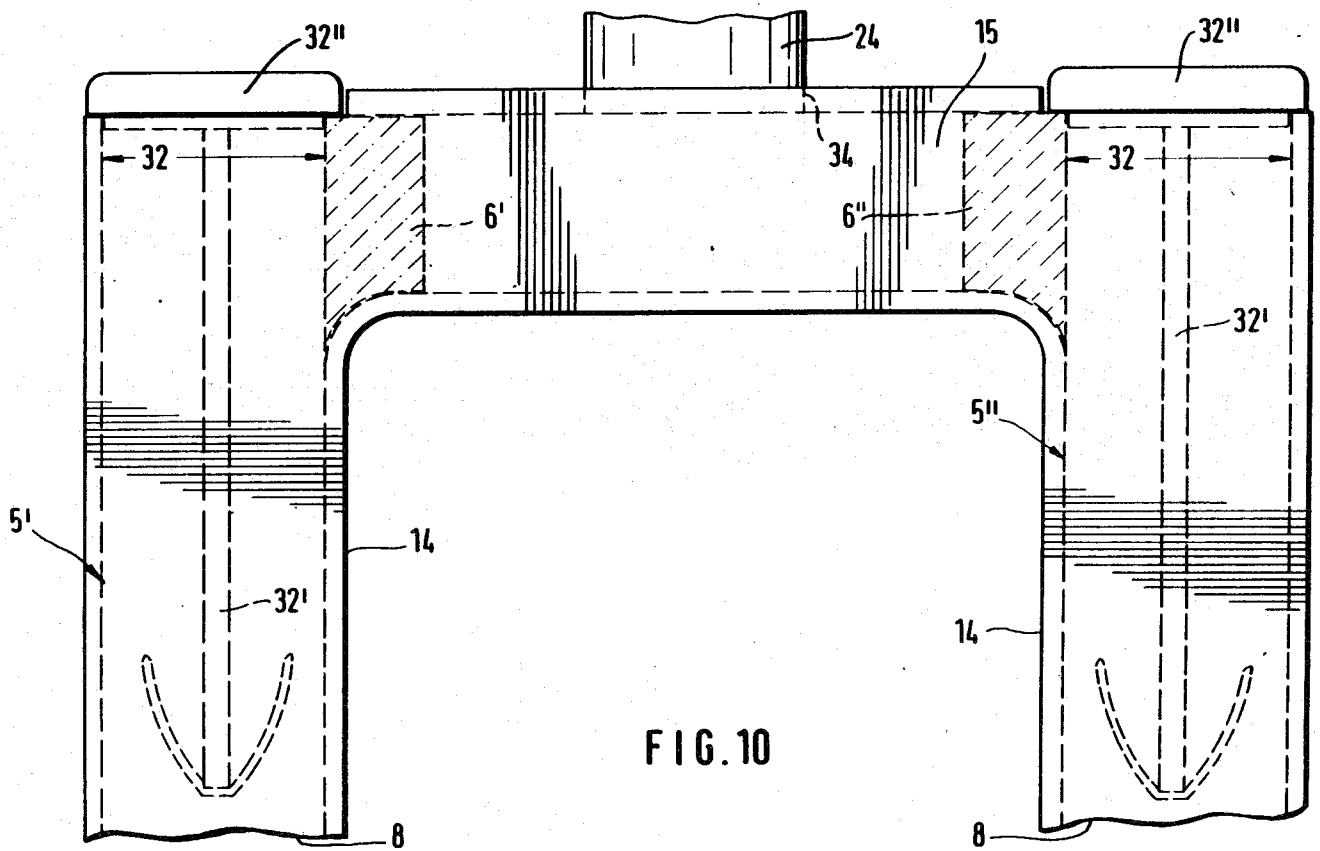
Figure 10A:
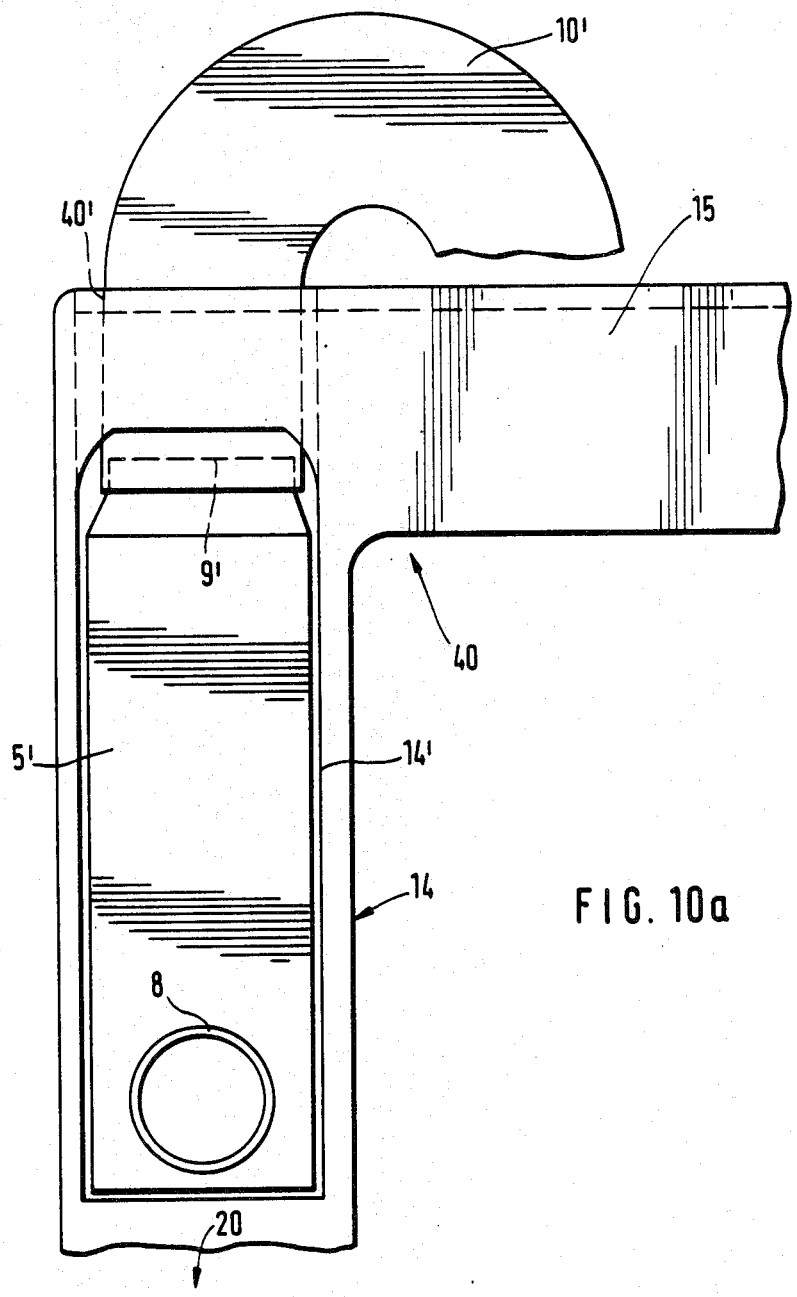

FIG. 3 shows details of the fixing of a suction unit to a carriage bracket of a flat bed knitting machine, FIG. 4 is a schematic cross section along the line IV—IV of FIG. 3, FIG. 5 is a plan view of a suction unit fixed to a carriage arm base, FIG. 6 is a schematic representation of a device for removing the collected fibre dust from a dust collecting chamber, FIG. 7 shows a connecting point of a suction nozzle duct to a dust collecting chamber, FIG. 8 is a schematic representation of a fixing facility for a dust collecting chamber to a carriage arm base, FIG. 9 is a side view of the fixing device shown in FIG. 8, FIG. 10 is a schematic part representation of a carriage arm, whose hollow voids of which are designed as dust collecting chambers, FIG. 10*a* shows a part of a carriage arm with an interchangeable inserted dust collecting chamber.

In FIG. 1 is shown suction nozzle 1 with front and rear needle bed top-face 2, suction nozzle orifice 3, a lateral suction slot 3', suction nozzle ends 4, a screw thread 4' and removal ducts 2' defined between the suction nozzle orifices 3 and the needle bed surfaces 2.

FIG. 2 shows the suction unit for a flat bed knitting machine, which is fitted with a support 11 to the front carriage arm base 14 for a suction action at the front needle bed surface; it is convenient according to the space requirement, for suction at the rear of needle bed surface to be the same form of fixing, but arranged in an opposite manner. FIG. 2 shows, in addition, a fibre dust collector 5, the suction nozzle end 4, an inlet port 8, a porous dust bag 7, and a dust bag holder 7', an outlet port 9, a suction elbow bend 10, ends 13 of the support and a ventilator housing 25, which comprises a carrier plate 16. Further provided are a curved web 17, the carrying supports 21, a rear wall 22, an inlet plate 23 and a protective grid 27, whereby the inlet feed pipe 24 leads to the blower 26, which is arranged in the blower housing 25, from which a drive motor 19, fixed on the carrier plate 16, is driven.

FIG. 3 shows the mounting of a suction unit for front and rear needle bed suction, the unit being fitted sidways to or upon the carriage bracket 15. In addition, the fibre dust collectors 5' and 5'' with outlet ports 9' and 9'', suction bends 10' and 10'', supports 11 and support ends 13 and the inlet feed pipe 24 are provided.

FIG. 4 shows a front elevation of FIG. 3 with the fibre dust collector 5', outlet port 9', suction bend 10', carriage top arm 15, support 11 with support ends 13, inlet feed pipe 24, housing 25, which consists of an inlet plate 23, a carrier plate 16, carrying support 21, rear wall 22 and the protective grid 27, together with the drive motor 19 and blower 26.

FIG. 5 shows a plan view of the front carriage arm base 14, with support 11, support ends 13, retaining angle 12, carrier plate 16, curved web 17, carrying support 21, rear wall 22, blower 26, protective grid 27, and the drive motor 19 with screws 29.

FIG. 6 shows the fibre dust collector 5 with removable air filter, fibre dust screw conveyor 45 with an opening 46, closing flap 47, closing plate 48, the fibre dust screw which tapers towards the opening and which only operates when the drive motor 19 is stationary, in order to force the compressed collected fibre dust from the opening 46. The fibre dust drops in pellets or wads into a pipe 49. The stopping and starting operation of the screw 45 is effected, like the drive motor, by an interval switching device.

FIG. 7 shows a fibre dust collector 5, the retaining angle 12, retaining angle 12', suction nozzle end 4, elastic cover 4(*a*), pressure plate 4(*b*), compression spring 4(*c*) with securement 4(*d*) and spring retaining web 4(*e*). The suction nozzle end 4 protrudes into the inlet port 8 of the fibre dust collector 5 and is surrounded by the elastic cover 4(*a*).

FIG. 8 shows a plan view on the front carriage arm base 14, in which the support 11 connected with the retaining angle 12, incorporates the fibre dust collector 5. In addition, FIG. 8 shows the support ends 13, the carrier plate 16, the bent web 17, the securement device (for the retaining band 31') 18' and 18", plus the safety support 30.

FIG. 9 shows the side view of FIG. 8 with the front carriage arm base 14, support 11, retaining angle 12, support ends 13, carrier plate 16, bent web 17, securement devices 18' and 18" for the expandable and elastic retaining band for the fibre dust collector 5, safety support 30, inlet port 8 and suction nozzle end 4.

FIG. 10 shows a carriage arm. The hollow voids of the front and rear carriage arm base 14 are designed as fibre dust collectors 5' and 5" and through its top openings 32 the collected fibre dust is removed by means of the dust removal bar 32', which is connected to the closing cover 32". In the hollow cavity of the carriage top arm 15 are fitted air filters 6' and 6", which hold back the fibre dust in the air stream drawn through suction. The top port 34 of the carriage top arm 15 is used to receive the inlet feed pipe 24 for further passage to the ventilator 26.

FIG. 10*a* shows a part of the carriage arm 40 with the hollow body of the carriage arm base 14, which has an opening port 14' on the side leading to the knitting zone 20, and in which the fibre dust collector 5' with the inlet port 8 is inserted and fixed. The suction elbow joint 10 is fitted in an air tight manner over the outlet port 9'.

| Nomenclature of printed numbers (item ref numbers) | | FIG. |
|---|---|---|
| (1) | Fibre dust suction nozzles | 1 |
| (2) | Front and rear needle bed | 1 |
| (3) | Suction nozzle orifices | 1 |
| (2') | Removal from suction nozzle orifices -3- up to surface of needle bed | 1 |
| (3') | Lateral suction nozzle slot | 1 |
| (4) | Suction nozzle end | 2,7 & 9 |

-continued

| Nomenclature of printed numbers (item ref numbers) | | FIG. |
|---|---|---|
| (4') | Screw thread on suction nozzle end | 1 |
| (4") | Elastic cover on suction nozzle end | 7 |
| (4"') | Pressure plate for suction nozzle end | 7 |
| (4"") | Compression spring for suction nozzle end | 7 |
| (4"""') | Spring retaining web | 7 |
| (4"""") | Securement for compression spring | 7 |
| (5) | Fibre dust collector | 2,7 & 9 |
| (5',5") | Fibre dust collector | 3,4, 10 & 10a |
| (9) | Fibre dust collector outlet port | 2 |
| (9',9") | " | 3,4 & 10a |
| (10) | Suction bend | 2,6 & 10a |
| (10',10") | " | 3,4 & 10a |
| (11) | Support | 2 to 5, 8 and 9 |
| (12) | Retaining angle | 5,8 & 9 |
| (12') | Retaining angles for fixing parts of suction nozzle end (4) | 7 |
| (13) | Support ends | 2 to 5, 8 and 9 |
| (14) | Front and rear carriage bracket base | 2,5,8 & 9 |
| (14') | Side opening of carriage bracket base | 10a |
| (15) | Carriage top bracket | 2 to 4,10 10a |
| (16) | Carrier plate | 2,4,5,8,9 |
| (17) | Bent web of carrier plate | 2,5,8,9 |
| (19) | Drive motor | 2,4,5 |
| (20) | Direction of the knitting zone | 1,2,3,5,10a |
| (18', 18") | Securement device for retaining bend | 8,9 |
| (21) | Carrying supports in ventilator housing | 2,4,5 |
| (22) | Rear wall in ventilator housing | 2,4,5 |
| (23) | Inlet plate (ventilator housing) | 2,4 |
| (24) | Inlet feed pipe for ventilator | 2,3,4,10 |
| (25) | Ventilator housing | 2 & 3 |
| (26) | Ventilator | 2,4,5 |
| (27) | Protective grid bars for ventilator | 2,5,4 |
| (29) | Retaining screws for drive motor | 5 |
| (30) | Locators/securement | 8,9 |
| (30') | Retaining band | 10 |
| (32) | Dust extraction ports/openings | 10 |
| (32') | Dust removal bars | 10 |
| (32") | Closing cover | 10 |
| (34) | Suction port/opening | 10 |
| (40) | Carriage bracket | 10,10a |
| (40') | Carriage top bracket opening | 10a |
| (45) | Screw/worm | 6 |
| (46) | Opening for the screw/worm | 6 |
| (47) | Closing flap | 6 |
| (48) | Closing plate | 6 |
| (49) | Pipe for fibre dust pellets | 6 |

We claim:

1. In combination, a flat knitting machine having a carriage which moves relatively to needle beds of the machine, an electrically powered suction blower adjustably mounted on the carriage for movement therewith, suction nozzles mounted on the carriage and directed at the needle beds and operatively connected with the blower, a dust collection chamber operatively connected with respect to the suction nozzles of the blower to collect debris drawn through the nozzles, said dust collection chamber being mounted in a hollow cavity within an arm of the carriage.

2. The invention of claim 1, including a dust collection chamber formed in each of the front and the rear carriage arms.

3. The invention of claim 1, including a screw conveyor means for packing the debris which collects in each dust collection chamber and transporting said debris to an opening, said conveyor being operable when the carriage is stationary.

4. The invention of claim 1, said dust collection chamber having a screw threaded inlet opening adapted to receive a similarly threaded exhaust nozzle.

5. The invention of claim 1, including a support plate fixed to the carriage arm, a drive motor mounted on one side of the support plate and the suction blower mounted on the other side of the support plate, and including an inlet guide tube connecting the suction blower inlet to the dust collection chamber.

6. The invention of claim 5, wherein the inlet guide tube is operatively connected to the dust collection chamber through a suction frame member.

7. The invention of claim 1, said suction blower having an inlet plate, and said inlet plate being connected to said carriage arm by means of a band-like holder.

8. The invention of claim 1, wherein said carriage arms include dust removal openings and including covers adapted to close said openings and provided with dust removal rods.

9. The invention of claim 1, said dust collection chambers being formed with special housings, said housings being insertable and height adjustable in their respective carriage arm, and being insertable into the cavity through side openings in the carriage arm lying in the direction towards a knitting zone of the knitting machine.

* * * * *